US010571091B2

(12) United States Patent
Albou

(10) Patent No.: US 10,571,091 B2
(45) Date of Patent: Feb. 25, 2020

(54) LIGHT MODULE WITH OPTIMIZED OPTICAL IMAGING FOR A PIXELLATED SPATIAL LIGHT MODULATOR, INTENDED FOR A MOTOR VEHICLE

(71) Applicant: VALEO VISION, Bobigny (FR)

(72) Inventor: Pierre Albou, Bobigny (FR)

(73) Assignee: VALEO VISION, Bobigny (FR)

( * ) Notice: Subject to any disclaimer, the term of this patent is extended or adjusted under 35 U.S.C. 154(b) by 14 days.

(21) Appl. No.: 15/964,743

(22) Filed: Apr. 27, 2018

(65) Prior Publication Data

US 2018/0313510 A1 Nov. 1, 2018

(30) Foreign Application Priority Data

Apr. 28, 2017 (FR) ..... 17 53756

(51) Int. Cl.
*F21S 41/675* (2018.01)
*F21S 41/63* (2018.01)
(Continued)

(52) U.S. Cl.
CPC ..... *F21S 41/675* (2018.01); *F21S 41/147* (2018.01); *F21S 41/255* (2018.01); *F21S 41/265* (2018.01);
(Continued)

(58) Field of Classification Search
CPC ..... F21S 41/675; F21S 41/635; F21S 41/265; F21S 41/147; F21S 41/37; F21S 41/255; F21S 41/68; F21S 41/285; F21S 43/40; F21S 43/14; F21S 43/31; F21S 43/26; F21S 45/47
See application file for complete search history.

(56) References Cited

U.S. PATENT DOCUMENTS 9,611,996 B2 * 4/2017 Brendle ..... F21S 41/143
2015/0160454 A1 6/2015 Bhakta
(Continued)

FOREIGN PATENT DOCUMENTS

FR 3 041 073 A1 3/2017

OTHER PUBLICATIONS

French Preliminary Search Report dated Dec. 21, 2017 in French Application 17 53756 filed on Apr. 28, 2017 (with English Translation of Categories of Cited Documents).

*Primary Examiner* — Mary Ellen Bowman
(74) *Attorney, Agent, or Firm* — Oblon, McClelland, Maier & Neustadt, L.L.P.

(57) ABSTRACT

The light module for motor vehicle offers a light source associated with a first part of an imaging system so as to produce a reflected beam coincident with the reflection surface of a high definition pixellated spatial light modulator, which makes it possible to avoid unnecessarily lighting the periphery of the spatial light modulator. The light source consists essentially in one or more light emitting diodes and/or has a punctiform or virtually punctiform appearance. The reflected radiation arrives on a second part of the imaging system, this part characteristically consisting in an optical projection system, some of whose elements can form a back focussing system. The module remains compact and is clearly suitable for providing adaptive lighting in a homogeneous, efficient manner and with high resolution.

19 Claims, 3 Drawing Sheets

Figure 1:
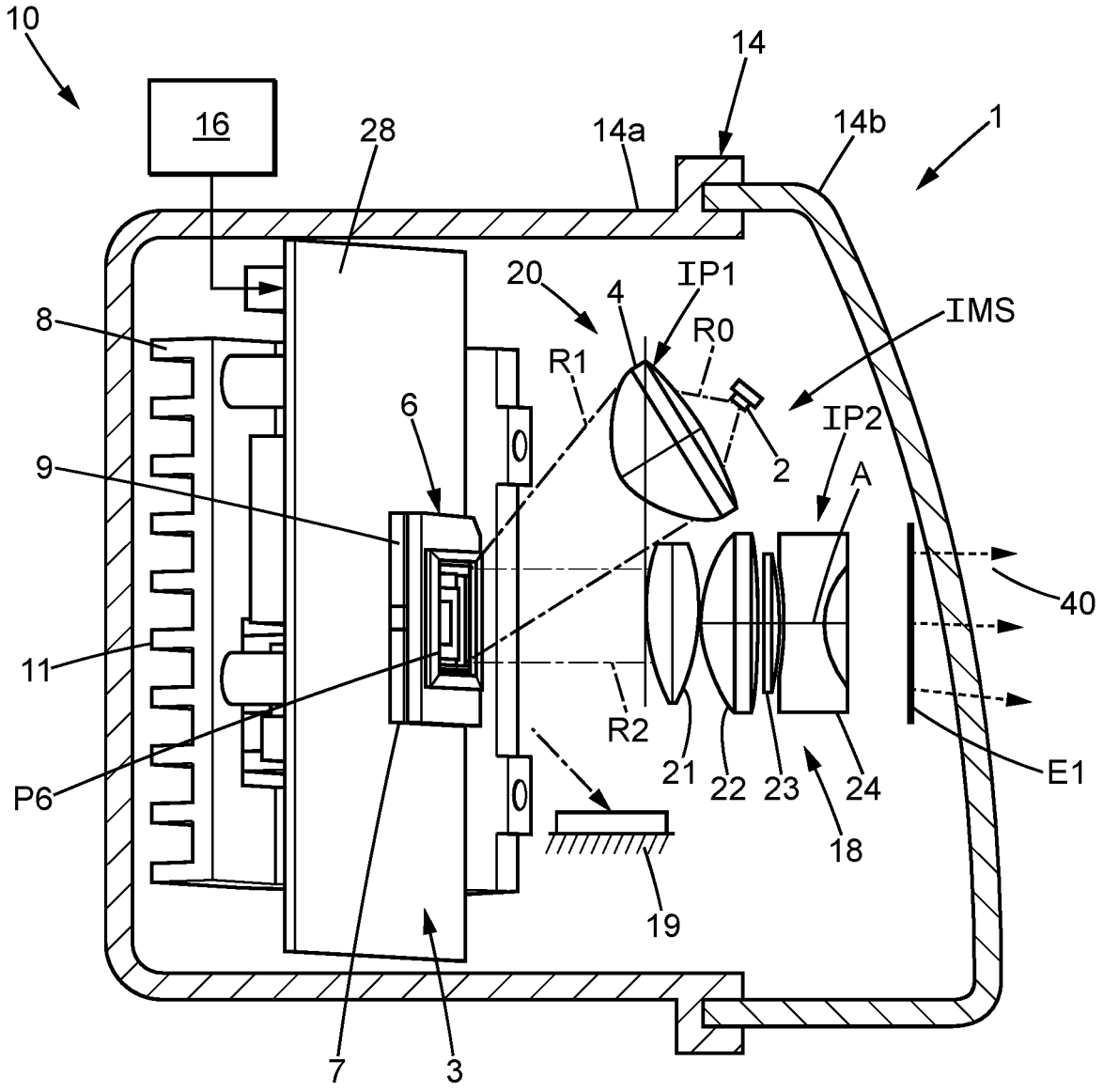

(51) Int. Cl.

| | |
|---|---|
| ***F21S 41/20*** | (2018.01) |
| ***F21S 41/68*** | (2018.01) |
| ***F21S 41/147*** | (2018.01) |
| ***F21S 43/14*** | (2018.01) |
| ***F21S 45/47*** | (2018.01) |
| ***F21S 43/20*** | (2018.01) |
| ***F21S 41/37*** | (2018.01) |
| ***F21S 41/255*** | (2018.01) |
| ***F21S 41/265*** | (2018.01) |
| ***F21S 43/31*** | (2018.01) |
| ***F21S 43/40*** | (2018.01) |
| ***F21Y 115/10*** | (2016.01) |
| ***F21S 43/33*** | (2018.01) |
| ***F21W 103/10*** | (2018.01) |
| ***F21W 103/15*** | (2018.01) |
| ***F21W 103/20*** | (2018.01) |
| ***F21W 103/55*** | (2018.01) |
| ***F21W 102/13*** | (2018.01) |

(52) U.S. Cl.

CPC ..... *F21S 41/285* (2018.01); *F21S 41/37* (2018.01); *F21S 41/635* (2018.01); *F21S 41/68* (2018.01); *F21S 43/14* (2018.01); *F21S 43/26* (2018.01); *F21S 43/31* (2018.01); *F21S 43/40* (2018.01); *F21S 45/47* (2018.01); *F21S 43/33* (2018.01); *F21W 2102/13* (2018.01); *F21W 2103/10* (2018.01); *F21W 2103/15* (2018.01); *F21W 2103/20* (2018.01); *F21W 2103/55* (2018.01); *F21Y 2115/10* (2016.08)

(56) References Cited

U.S. PATENT DOCUMENTS

2015/0377442 A1 12/2015 Bhakta et al.
2016/0347237 A1* 12/2016 Bhakta ..... F21S 41/285

* cited by examiner

LIGHT MODULE WITH OPTIMIZED OPTICAL IMAGING FOR A PIXELLATED SPATIAL LIGHT MODULATOR, INTENDED FOR A MOTOR VEHICLE

The present invention relates to vehicle lighting, in particular forwards or rearwards. The invention more precisely relates, in the motor vehicle field, to a light module provided with a pixellated spatial light modulator, for example consisting of a digital micromirror device (DMD) whose micromirrors are controllable.

A light device for motor vehicle is known that comprises a light source, a digital micromirror device or similar modulator device enabling a light beam to be broken down into pixels distributed along two dimensions. The digital micromirror device is generally used to reflect the light rays coming from the light source to optics for shaping the light beam, the optics being intended to project the figure formed onto the digital micromirror device, in the form of an outgoing light beam. This light beam makes it possible for example to light the road on which the motor vehicle comprising this light device is travelling, or fulfils a signalling role.

Lighting with projection using a digital micromirror device or similar pixellated spatial light modulator offers the possibility of providing bright light and adaptive solutions for numerous applications. The function can be quoted that consists in forming an adaptive beam so as to light the route at the pertinent place, if need be so as not to dazzle vehicles approaching in the opposite direction on bends, which is generally designated by the abbreviation DBL (Dynamic Bending Light). In a manner known per se, the matrix grouping the digital micromirror devices breaks the outgoing beam down into pixels, which enables the projected light beam formed with a digital micromirror device to be shaped in an adaptive manner so as to be suitable for a variety of needs. The control circuit can be advantageously used to segment and/or shape in an adaptive manner the projected light beam, for example so as to avoid the eyes of drivers coming from the opposite direction. The control sensors and circuits can be used to automate this "no dazzling" function.

When forming an adaptive beam, some of the micromirrors in a DMD matrix can be in an inactive position (due to a certain tilt), while other mirrors are oriented to the "go" position and reflect the light to the imaging system, for example, a projection lens. This way, it is possible to shape the light beam projected by the lens. However, the light radiation directed to the micromirrors of the DMD matrix is only very partially used, and it is generally considered that the use of a digital micromirror device is no longer efficient in terms of energy.

A need therefore exists to use in an efficient manner illumination sources with a DMD matrix, including when the illumination sources are of a simple/inexpensive type such as LEDs or similar elements.

In order to improve the situation, the invention proposes a light module for motor vehicle, intended to shape a light beam, the light module including:

- a light source,
- an imaging system suitable for creating an image of the light source,
- a high definition pixellated spatial light modulator presenting a zone of reflection having a determined format, the imaging system including at least two optical elements distributed upstream and downstream of the spatial light modulator, following the direction of propagation of the light emitted by the light source, such that there is at least one optical element of the imaging system upstream, and at least one optical element of the imaging system downstream of the high definition pixellated spatial light modulator, the imaging system including, in a first imaging part, a lens for adjustment to a characteristic dimension of the determined format, suitable for concentrating a radiation from the light source (the effect of adjustment is for example such that the gross radiation coming from the light source is converted, after passing through the lens, to a first radiation that is within the limits of the perimeter of the zone of reflection of the spatial light modulator when it reaches this perimeter).

The imaging system is therefore designed to shape an intermediate image on one hand (on the upstream side of the spatial light modulator) and to shape the image to be projected on the other (on the downstream side of the spatial light modulator).

Usually for this type of light module, it is understood that the image created at the output of the imaging system, also called output image, is the image that will be perceived outside the module. The outgoing beam simply propagates this output image, without supplementary optical processing outside the light module.

A spectacular increase in optical performance can be obtained by shaping upstream of the high definition pixellated spatial light modulator. It is permitted to eliminate a collimator since it is a question of lighting by forming an intermediate image. The flux performance is improved by concentrating the beam emitted from the light source, optionally with anamorphic compression of the illuminating beam directed onto the zone of reflection or active zone of the high definition pixellated spatial light modulator. This makes it possible to adjust the intermediate image of the source formed on the zone of reflection, closest to the outer dimensions of this zone. In practice, the outer rays of the beam on the upstream side can then be incident along the perimeter of the zone of reflection, without passing outside of this perimeter.

According to one particularity, the high definition pixellated spatial light modulator is defined by a digital micromirror device having a zone of reflection whose largest dimension is greater than the largest dimension of the light source.

In the case of a significantly elongated zone of reflection, with for example a length approximately double the width, the part of the imaging system upstream of the spatial light modulator can perform an anamorphosis. More generally, a technical advantage of this type of solution, potentially with anamorphic compression of the image of the light source in one direction, is that it is permitted to make the intermediate image coincide with the structure of the spatial light modulator, while permitting that this same image is magnified so as to fill the input dioptre of the optical projection system, on the downstream side of the spatial light modulator.

Furthermore, the output image can be very homogeneous. It is furthermore permitted to avoid unnecessarily heating the periphery of the zone of reflection, which is generally sensitive to heat.

An optical module according to the invention can include one or more of the following characteristics:

- The zone of reflection of the high definition pixellated spatial light modulator has a rectangular format and is delimited by a rectangular perimeter.
- The light module includes an optical projection system including several lenses and able to correspond to a second imaging part of the imaging system.

The lens furthermore permits an adjustment to the shape of the zone of reflection.

At least one of the optical elements of the imaging system, defining the first imaging part, comprises a lens for adjustment to the determined format, this adjustment lens being designed and arranged so as to concentrate the radiation from the light source by defining a contour shape of the radiation that corresponds to the shape of a perimeter of the zone of reflection defined by the spatial light modulator.

The first imaging part, arranged upstream of the spatial light modulator, following the direction of propagation of the light emitted by the light source, has at least one transparent optical element with an anamorphosis effect; it is therefore permitted for example characteristically to compress the vertical component and/or the horizontal component of the beam directed towards the spatial light modulator, so as to make this beam coincide precisely with the dimensions of the zone of reflection of the spatial light modulator.

The first imaging part, arranged upstream of the spatial light modulator, has an anamorphosis effect mirror.

The high definition pixellated spatial light modulator comprises a digital micromirror device, the micromirrors of the digital micromirror device each being moveable between:

a first position in which the micromirror is arranged so as to reflect light rays of a first radiation reaching it from the first imaging part of the imaging system, in the direction of an optical projection system including or defining a second part of the imaging system, and a second position in which the micromirror is arranged so as to reflect the light rays of the first radiation reaching it from the first imaging part of the imaging system, away from the optical projection system.

The high definition pixellated spatial light modulator comprises a displaying reflective zone of the liquid crystals on silicon type.

The high definition pixellated spatial light modulator comprises a matrix of micromirrors distributed in a plane, the matrix defining an optical axis characteristically perpendicular to this plane and which spans in a central manner the optical projection system.

At least during the performance of a photometric function of the module, active micromirrors of the digital micromirror device are in an active state rotated through a determined angle, preferably comprised between 6 and 15°, towards a optical element of the convergent type situated upstream of the spatial light modulator and which belongs to the imaging system. This orientation thus characteristically comes close to the line normal to these mirrors of the source and/or of the illuminating lens.

The light source and the optical element of the convergent type are:

preferably laterally offset, on the same side, relative to the micromirrors of the digital micromirror device, and associated such that the light ray that travels the longest distance between the optical element of the convergent type and a micromirror in an active state on one hand and the light ray that travels the shortest distance between the optical element of the convergent type and a micromirror on the other, are reflected so as to enter the optical projection system while passing through the edges of the first lens (convergent), potentially in a manner substantially perpendicular to the matrix of micromirrors. The expression substantially perpendicular here means strictly perpendicular or with an offset less than or equal to 3° relative to the strictly perpendicular direction.

An optical element of the convergent type, situated upstream of the spatial light modulator, and which belongs to the imaging system defines, from the light emitted by the light source, a first radiation projected onto a zone of reflection of the spatial light modulator while forming on this zone of reflection an intermediate image, which is distorted by said optical element of the convergent type.

The optical element of the convergent type extends in a position (for example at less than 3 or 5 mm) adjacent to another optical element onto which a second radiation is directed, which comes directly from a reflection of the first radiation on the spatial light modulator, the other optical element preferably forming a first optical element of an optical projection system belonging to the imaging system. More generally, so as to optimize the optical performance of the system, it can be envisaged that this element is adjacent to or near the envelope of the light rays upstream of the light modulator.

The optical element of the convergent type extends comparatively further from the high definition pixellated spatial light modulator and nearer to the other optical element onto which the second radiation, which comes directly from a reflection of the first radiation on the spatial light modulator, is directed. Certain elements of the optical projection system form a system of back focussing.

The optical projection system comprises, successively in this order, along a distancing direction relative the spatial light modulator:

the first optical element arranged as an input lens of the optical projection system so as to capture the second radiation (the shape and the dimensions of this input lens characteristically make it possible to capture in its entirety this second radiation directed in a general manner towards an output surface of the light module);

a pair of optical elements, potentially composed of two optical lenses, making it possible to make the focal length of the optical projection system smaller than the back focus of said optics (in other words, the focal length is reduced relative to a longer focal length that would be obtained for the optical projection system in the absence of this pair of optical elements).

The input lens of the optical projection system consists in a biconvex lens, preferably spherical biconvex.

The optical projection system furthermore comprises an achromat.

The achromat can form one of the optical elements of the pair of optical elements.

The optical projection system furthermore comprises a crown glass thinner than the other lenses of the optical projection system and placed between two final lenses of the optical projection system.

The light source comprises or consists essentially in one or more light emitting diodes.

The group of light emitting diodes defining the light source is assembled on a common support. When several sources are used, each can potentially have its own optics upstream of the matrix. The solution with back focussing and characteristically with an achromat makes it possible to obtain a compact module, so as to light in a homogeneous manner over an extended field, at the same time optimizing the performance in terms of energy thanks to the shaping part provided upstream of the high definition pixellated spatial light modulator.

According to another particularity, the light source is part of a unit for emitting light rays provided with at least one reflecting surface distinct from the spatial light modulator and making it possible to orient the light source along a direction for distancing the light relative to a zone of reflection of the spatial light modulator (in this case, it is understood that the axis of emission from the source is not directed more or less towards the matrix).

According to a particularity, a projection screen is provided in the light module, for example parallel to a zone of reflection of the spatial light modulator. The term "parallel" can be interpreted here with a certain tolerance, characteristically of more or less 1 to 5°. A second part of the imaging system can be suitable for creating the desired image on the projection screen based on an intermediate image of the light source formed on the zone of reflection. The intermediate image is obtained in turn by using a first part of the imaging system and extends exclusively inside a perimeter of the zone of reflection, so as to avoid unnecessarily heating the periphery of this zone of reflection.

Another object of the invention is to propose a projector for motor vehicle, comprising a projector housing and at least one optical module according to the invention so as to perform a lighting and/or signalling function.

It is understood that this type of projector can advantageously offer homogeneous lighting from a source, for example a light source with one or more light emitting diodes, targeting in a suitable manner the active reflection surface of the DMD without overflowing, without optical collimation.

In the case of several diodes, these can be grouped on a common mount or potentially distributed over several mounts.

The energy performance is greatly improved by using a high aperture optical imaging element.

Figure 2:
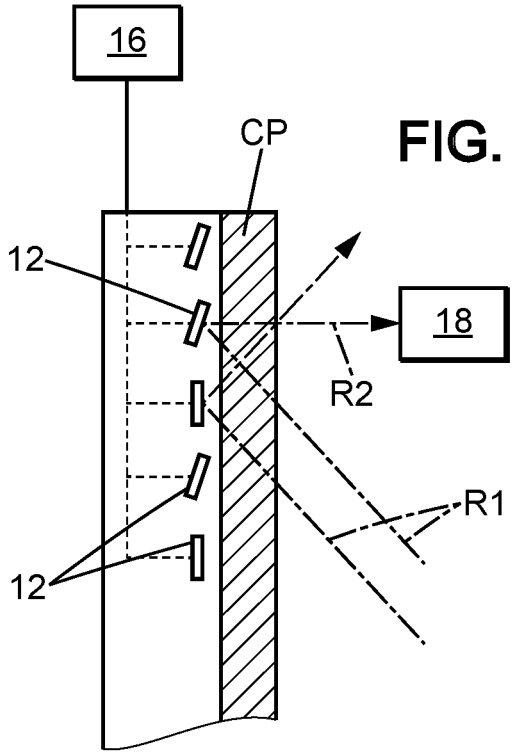
Figure 3:
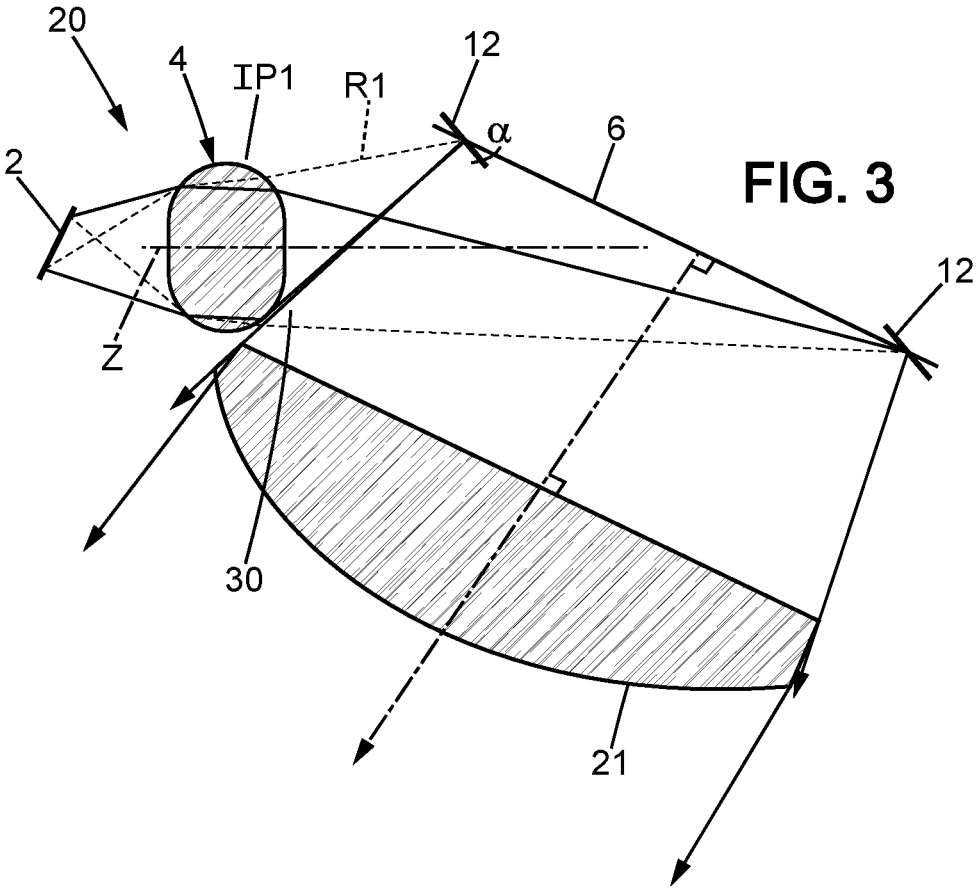
Figure 4:
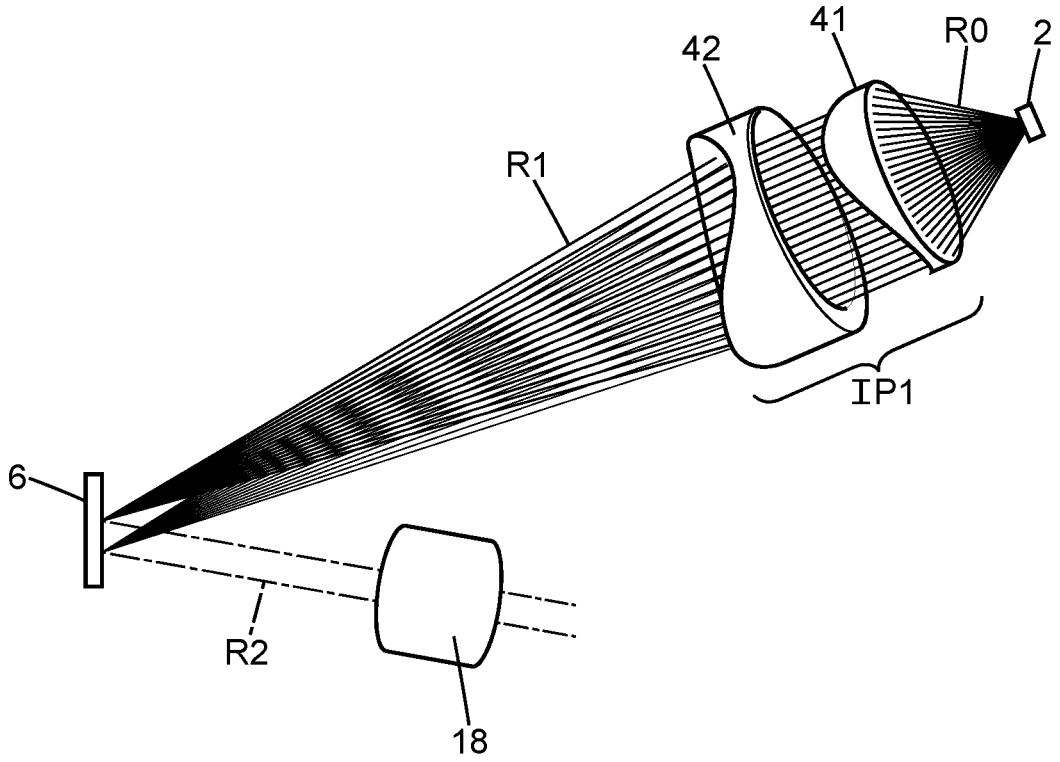

Other characteristics and advantages of the invention will emerge throughout the following description of several of its embodiments, given as non-limitative examples, with reference to the attached drawings, in which:

FIG. 1 diagrammatically illustrates an example of a lighting projector for motor vehicle comprising a light module according to a first embodiment;

FIG. 2 diagrammatically illustrates in section a detail of a digital micromirror device forming the high definition pixellated spatial light modulator, used in the optical module of FIG. 1;

FIG. 3 diagrammatically illustrates the trajectory of the light either side of the high definition pixellated spatial light modulator;

FIG. 4 illustrates an embodiment variant for concentrating the radiation from the light source onto the zone of reflection of the spatial light modulator, with an anamorphosis effect.

On the different figures, the same references designate identical or similar elements. Some elements may have been magnified on the drawings so as to facilitate understanding.

FIG. 1 illustrates a first embodiment of an optical module 1 for motor vehicle, capable of being integrated for example in a front light or a rear light. The optical module 1 forms a light-emitting device configured for implementing one or more photometric functions.

The optical module 1 comprises, as illustrated, a light source 2, a digital micromirror device 6 (DMD), a control unit 16, for example in the form of a controller making it possible to control micromirrors 12 of the digital micromirror device 6 and an optical projection system 18 (or shaping optical system), which belong to an imaging system IMS. The control unit 16 can optionally be delocalized, for example so as to allow several optical modules 1 to be controlled.

The micromirrors 12 are distributed in a plane, such that the matrix 6 defines an optical axis A that coincides substantially with a central axis of the optical projection system 18. As is clearly visible on FIG. 1 in particular, the optical projection system 18 is provided here between the zone of reflection of the digital micromirror device 6 and a projection screen E1.

Although the drawings illustrate a digital micromirror device 6, it is understood that the light rays emitted by the light source 2 can be directed, by means of suitable optics, to any type of high definition pixellated spatial light modulator 3, which makes it possible to break the received radiation R1 down into pixels. In an embodiment variant, a matrix of pixels can be used that is provided with active surfaces in the focal plane of the optical projection system in the shape of pixels of the liquid crystal on silicon (LcoS) type. In effect, a device with a LcoS matrix can be appropriate. More generally, it is understood that a first radiation R1 can be received on a very finely subdivided surface so as to define pixels with a high definition, characteristically with 1280×720 pixels, or even more, knowing that a lower definition would also be acceptable in many cases, in particular 640×480, and whose configurations can be modulated. The change of state is preferably permitted for each pixel, in a manner known per se.

The light source 2 can consist in a light-emitting element such as a light emitting diode (or LED) or a matrix of LEDs. In the case of a group of light emitting elements, these are preferably tightly packed in a single zone akin to a single light source. A laser diode, coupled if need be with a collimator system and potentially a device for converting wavelength, can also make it possible to form a gross radiation R0.

With reference to FIG. 1, the light source 2 makes it possible here to form the gross radiation R0. This gross radiation R0 is oriented, directly or indirectly, towards a first part IP1 of the imaging system IMS. This first part IP1 can be defined by a lens 4 designed and arranged so as to define a modified image of the light source 2. The lens 4 can be of a useful perimeter larger than or equal to the perimeter P6 of the zone of reflection of the digital micromirror device 6 or zone of reflection of a high definition spatial light modulator 3 equivalent to this kind of matrix. More particularly, the lens 4 is characteristically a lens functioning at maximum aperture, for which some aberrations are not a problem, which results here in a large diameter.

Here, in the digital micromirror device 6, each of the micromirrors 12 is moveable, between:

- the first position in which the micromirror 12 reflects the incident light rays of the radiation R1 in the direction of the optical projection system 18,
- and the second position in which the micromirror 12 transmits by reflection the incident light rays of the radiation R1 away from the optical projection system 18, for example towards a device 19 for absorbing radiation, which has a surface that absorbs light.

As can be seen on FIG. 2, the digital micromirror device 6 can optionally be covered with a CP layer for protecting the micromirrors 12, this layer being transparent. The pivot axis of each of the micromirrors 12 can permit, as a non-limitative example, a rotation of more or less 10° or more or less 12° relative to a nominal position without rotation.

The radiation R1 obtained at the output of the lens 4 is convergent towards a virtual point situated further than the digital micromirror device 6. The radiation R2 coming from the reflection onto this matrix 6 can be focused to infinity or towards a point outside the module 1 and distant. The energy of the radiation R2 can be received in its entirety by the optical projection system 18 that forms the second part IP2 of the imaging system IMS.

With reference to FIGS. 2 and 3, so as to obtain such a parallelism of the reflected beam intended for the optical projection system 18, it is envisaged that the active micromirrors 12 are oriented in a similar or identical manner. The first part IP1 of the imaging system IMS is dimensioned and designed/assembled in the light module 1, such that the general plane of the zone of reflection is tilted relative to the optical axis Z (FIG. 3) of the illumination system. In the case of FIG. 3, the lens 4 defines the output of an illumination system for lighting the digital micromirrors device 6. More particularly, the optical axis Z shown on FIG. 3 and the plane of the zone of reflection are tilted relative to each other by an angle that is for example double the angle of rotation a of the mobile micromirrors 12 (for example 2×12°=24°), which makes it possible to place the centre of the zone of reflection on the optical axis A of the lens or optical projection system 18 and to make sure that the main ray of the illumination system is reflected along this optical axis A. Optionally, the digital micromirror device 6 can be tilted more to prevent the optical projection system 18 from creating a shadow in the light beam coming from the reflection by the digital micromirror device 6.

In the examples of FIGS. 1 and 3, relative to the micromirrors 12 of the digital micromirror device 6, the light source 2 and the lens 4 can be completely laterally offset, so as not to interfere with the radiation R2, which is reflected from the zone of reflection of the digital micromirror device 6.

In order to optimize the optical performance of the system, it can be envisaged that the lens 4 and another optical element 21 are adjacent or close to each other, and/or positioned such that the optical element 21 and the envelope of the light rays upstream of the modulator 3 are as close as possible to each other. In the illustrated and non-limitative example, the lens 4 can extend in a close position, for example less than 5 mm, such that the lens 4 is adjacent to this other optical element 21 onto which the second radiation R2 coming directly from the reflection on the digital micromirror device 6 is directed. A vertical virtual axis can for example simultaneously cross or be tangent to the respective input surfaces of the first part IP1 and of the second part IP2. More generally, the lens 4 can be disposed close to the optical element 21, characteristically being closer to this optical element 21 than to the digital micromirror device 6.

With reference to FIG. 4, the first part IP1 can alternatively be composed of an anamorphic illumination system. In this example, the light source 2 can form a surface area of 1.7×1.7 $mm^2$, while the zone of reflection of the digital micromirror device 6 (DMD) extends in a rectangular manner over a larger surface area (for example 12×6 $mm^2$). Without this being limitative, it could be preferred that the light source 2, which is characteristically composed of a group of diodes, has a compact aspect, not exceeding for example 9 or 10 $mm^2$, preferably not exceeding 3 or 4 $mm^2$, or potentially virtually punctiform, with an emission surface of the order of 0.1 $mm^2$.

Here, the anamorphic system illuminates the digital micromirror device 6 by using two crossed cylindrical lenses 41, 42 having rotating aspherical input sides, characteristically for (partial) correction of aberrations. The lens 41 closer to the light source 2 has its power in the sense of higher magnification, horizontally here when the horizontal dimension of the zone of reflection is larger than its vertical dimension. It is understood that the anamorphosis makes it possible to illuminate the reflection surface homogeneously and advantageously allows options with high aperture of the imaging system IMS.

Depending on the needs, it is possible to envisage increasing the aperture (here approximately 0.32 compared with 0.53 in the embodiment example of FIG. 3, optimized by the design and position of the lens 4).

In an embodiment variant, the first imaging part IP1 arranged upstream of the spatial light modulator 3 has an anamorphosis effect mirror, for example a mirror with a concave reflecting surface. In this type of case, the light source 2 can optionally be part of a unit for emitting light rays 20 provided with at least one reflecting surface (not illustrated) distinct from the high definition pixellated spatial light modulator 3. The reflecting surface is of a type known per se, and will therefore not be described here; it can make it possible to orient the light source 2 along a direction for distancing the light relative to a zone of reflection of the high definition pixellated spatial light modulator 3.

More generally, it is understood that the first part IP1 can have at least one optical element (4; 41, 42), situated upstream of the spatial light modulator 3 and which belongs to the imaging system IMS, so as to define, from the light R0 emitted by the light source 2, the first radiation R1 projected onto the zone of reflection of the spatial light modulator 3. Characteristically, an intermediate image is formed on this zone of reflection and is distorted by an optical element of the convergent type, here in the shape of the lens 4 or of an anamorphic system.

The optical projection system 18 of the second part IP2 allows shaping of the radiation R2 complementary to the shaping performed by the first part IP1. This shaping by the optical projection system 18 makes it possible to shape an outgoing beam 40, which has a photometric function suitable for a vehicle, in particular a motor vehicle.

A preferred photometric function associated with the optical module 1 is a lighting and/or signalling function visible to a human eye. These photometric functions can be the object of one or more regulations that establish requirements for colorimetry, intensity, spatial distribution according to a grid called photometric grid, or ranges of visibility of the emitted light.

The optical module 1 is for example a light device constituting a vehicle projector 10—or headlamp. It is then configured to implement one or more photometric functions chosen for example among a low beam function called "dipped beam", a high beam function called "main beam", a fog beam.

Alternatively or in parallel, the optical module 1 is a signalling device intended to be arranged at the front or at the rear of the motor vehicle.

The projector 10 for motor vehicle illustrated on FIG. 1 can be accommodated in a housing 14 or be delimited by this housing 14. The housing 14, as illustrated, includes a body 14*a* forming a hollow inner space accommodating the optical module 1 at least in part. A cover 14*b*, transparent at least in part, is coupled with the body 14*a* so as to close the inner space. As illustrated, the cover 14*b* also forms a hollow, partially accommodating the optical module 1, in particular all or part of the optical projection system 18.

The cover 14*b* is embodied for example in plastic resin or other suitable plastic material. The lighting projector 10 can include several optical modules 1, which are then suitable for emitting neighbouring beams, the beams overlapping, preferably, in part. In particular, the lateral ends of the neighbouring beams can be superposed.

When it is intended to be arranged at the front, the photometric functions that can be implemented by using the optical module 1 (potentially as well as those it implements in its light device capacity) include a function for indicating a change of direction, a daytime running light (DRL), a front luminous signature, a position light function, a function called "side marker".

When it is intended to be arranged at the rear, these photometric functions include a function for indicating reversing, a stop function, a fog function, a function for indicating a change of direction, a rear luminous signature function, a lamp function, a side signalling function.

In the case of a signalling function of a rear light, the light source 2 can be red. In the case of a function for a front light, the light source 2 is preferably white.

Preferably, the light source 2 is tilted in the direction of the optical projection system 18, such that the axis of emission of the lens 4 is offset from the optical axis of the lens 4 or from the optical imaging part IP1 in the plane defined by the optical axes of the optical projection system 18 and of the lens 4 or of the optical projection system 18 and of the part IP1, respectively depending on the variant adopted. As is clearly visible on FIG. 1 or FIG. 3, the light source 2 remains opposite the zone of reflection of the digital micromirror device 6 or other zone of reflection of the spatial light modulator 3, so as to optimize the sharpness of the image. Although this sharpness is not important in itself for many applications, this guarantees the absence of light overflowing beyond the perimeter P6 of the zone of reflection. Losses and potentially dangerous peripheral heating in the spatial light modulator 3 are therefore avoided.

In this case, the light source 2 can advantageously be disposed a short distance, for example, less than 10 or 15 mm, from the lens 4 which here is convergent. As is clearly visible in particular on FIG. 3, this makes it possible to obtain all the same a flared shape of beam for the light rays of the radiation R1 that propagate between the unit for emitting light rays 20 and the digital micromirror device 6. Alternatively or in addition, the unit for emitting light rays 20 includes a reflecting mirror.

With reference to FIG. 1, the digital micromirror device 6 is essentially defined here by an electronic microchip 7, fastened to a printed circuit board 8 via a suitable connector (or socket) 9. A cooling device, here a radiator 11, is fastened to the printed circuit board 8 to cool the printed circuit board 8 and/or the microchip 7 of the digital micromirror device 6. So as to cool the microchip 7 of the digital micromirror device 6, the radiator 11 can have a salient relief spanning an opening in the printed circuit board 8 so as to be in contact with this microchip 7, the connector 9 leaving a free passage for this salient relief. A thermal paste or any other means of assisting heat exchange, accessible to the person skilled in the art, can be interposed between the salient relief and the digital micromirror device 6.

The digital micromirror device 6 is for example rectangular. The digital micromirror device 6 therefore extends mainly along a first direction of extension, between lateral ends of the digital micromirror device 6. Along a second direction of extension, which can correspond to a vertical dimension (height), two opposite end edges are also found that are characteristically parallel to each other.

The first part IP1 of the imaging system IMS makes it possible to obtain homogeneity of the illumination on the digital micromirror device 6, the radiation R1 corresponding to illumination on the digital micromirror device 6 with spatial variation of the emittance similar to that of the light source 2. In effect, the tilt makes the variation of emittance slow and limited. So as to avoid creating a problem of chromatism from the stage of illuminating the digital micromirror device 6, it is optionally possible to use optics the least possible sensitive to variations of wavelength (for example for a single lens 4, it is possible to use a crown glass, preferably a crown glass of the PSK53 type).

With reference to FIGS. 1 and 3, the light module 1 has a first optical element 21 arranged as an input lens of the optical projection system 18, making it possible to capture the second radiation R2. A spherical biconvex lens can constitute this first optical element 21. Depending on the direction of propagation of the light (moving away from the digital micromirror device 6), a group of dioptres is then provided downstream of the first optical element 21, making it possible to define a system of back focussing, preferably with at least one supplementary convergence.

As illustrated, the first optical element 21 can be placed downstream and in a position adjacent to the zone of intersection 30 of the light beam corresponding to the radiation R1 and the reflected beam corresponding to the radiation R2 in the activated state of all the pixels of the spatial light modulator 3. It is dimensioned to capture the totality or the major part of the reflected beam.

The optical projection system 18 ensures that the marginal rays are collimated, such that the light reaching an input dioptre of the set of lenses that follows this input dioptre is not lost. An achromat 24 can for example be provided as the last optical element.

The back focussing effect is obtained here by the presence of a convergent lens 22 and a divergent lens (which can potentially be part of the achromat 24 or be comprised of an independent lens 23). The short focal length characteristically required when the light module 1 is to function with a wide field (wide angle) is therefore achieved, with the counter-grid length required by the illumination and the geometry of the beam reflected by the digital micromirror device 6.

The illustrated example is absolutely not limitative. Characteristically, the achromat 24 can be placed while optionally omitting the lens 23, or a simple lens can be placed as a replacement for the achromat 24, with in this case a lens 23 formed in a specific glass different from that used in the next simple lens. It is understood that the set formed by the elements 23 and 24 makes it possible to reduce chromatic aberrations. Potentially, for example for a monochromatic application of the rear light type, it is possible to omit the lens 23 and to have a simple lens instead of an achromat as the final element replacing the achromat 24.

In embodiment variants, more lenses and at least two different materials can be added (low chromatic dispersion glass of the crown type on one hand and glass generally called "flint glass" in the optical field on the other), and can be used to correct geometric aberrations and to cancel chromatism to first order. The light module 1 can therefore supply outgoing radiation corresponding substantially to visible white, or potentially yellowish, light.

Optionally, so as to make it possible more effectively to cancel chromatism, the optical projection system furthermore comprises crown glass, typically thinner than the other lenses of the optical projection system 18, and placed between two lenses of the optical projection system 18, for example between two final lenses.

The type of configuration of the optical projection system 18, shown on FIG. 1, is clearly suitable when the back focussing of this optical system is determined by the imposed position of its input dioptre, knowing that the surface area of its input pupil must generally be at least equal to that of this input dioptre. The focal length of the optical projection system 18 can be determined by the desired angular aperture of the beam, horizontally or vertically, depending on the relation between the aspect ratio reflection surface area of the digital micromirror device 6 and the relation of the desired horizontal and vertical apertures for the beam to be projected (the aperture in the other direction being able to be achieved by means of an anamorphosis).

One of the advantages of the light module 1 is that it makes it possible to project a homogeneous light beam with a power optimized relative to the energy supplied to the light source 2 and with the possibility of making the incident radiation R1 coincide exactly with the size and shape of the active structure of the spatial light modulator 3. This makes the light module 1 suitable for high aperture optics.

It should be obvious to persons skilled in the art that the present invention enables embodiments in many other specific forms without departing from the field of application of the invention as claimed.

Therefore, when the optical module 1 has been illustrated for a case in which the projection screen E1 is defined internally relative to the transparent wall forming the window of the transparent cover 14*b*, it is understood that a part of the transparent cover 14*b* or other element forming part of the outer housing 14 can define the projection screen. The optical projection system 18 can for example be focused on a film formed on the inside of the window rather than on a distinct screen.

Likewise, additional functions can be implemented depending on the needs. For example, it is understood that an indication or mark can be added inside the outgoing light beam 40. The light module 1 can have digital high aperture optical imaging (0.6 or 0.7 as a non-limitative example). The use of a high definition pixellated spatial light modulator 3 and the correction of aberrations make it possible to form characters (letters, numbers or similar) with sufficient resolution to make it possible to display for the attention of persons outside the vehicle messages or pictograms, which are for example representative of the activation of a functionality or of a functioning context of the vehicle.

The invention claimed is:

1. Light module for motor vehicle, intended to shape a light beam, the light module comprising:

a light source;

an imaging system suitable for creating an image of the light source;

a high definition pixellated spatial light modulator presenting a zone of reflection having a determined format, wherein the imaging system includes at least two optical elements distributed upstream and downstream of the high definition pixellated spatial light modulator, following the direction of propagation of the light emitted by the light source, such that there is at least one element of the imaging system upstream, and at least one element of the imaging system downstream of the high definition pixellated spatial light modulator, wherein the imaging system further includes, in a first imaging part, a lens for adjustment to a characteristic dimension of the determined format, suitable for concentrating a radiation from the light source, and wherein the light module further includes a projection screen relative to a zone of reflection of the high definition pixellated spatial light modulator, a second part of the imaging system being suitable for creating said image on the projection screen, based on an intermediate image of the light source formed on the zone of reflection by using a first part of the imaging system, said intermediate image extending entirely inside a perimeter of the zone of reflection.

2. Light module according to claim 1, wherein the high definition pixellated spatial light modulator is defined by a digital micromirror device having a zone of reflection whose largest dimension is greater than the largest dimension of the light source.

3. Light module according to claim 1, wherein the determined format of said zone of reflection has a rectangular perimeter format.

4. Light module according to claim 1, wherein at least one of the optical elements of the imaging system forms said first imaging part, which comprises:

the adjustment lens for adjustment to the determined format, designed and arranged so as to concentrate the radiation from the light source by defining a contour shape of the radiation that corresponds to the shape of a perimeter of the zone of reflection defined by the high definition pixellated spatial light modulator.

5. Light module according to claim 3, wherein the first imaging part, arranged upstream of the high definition pixellated spatial light modulator has at least one transparent optical element with an anamorphosis effect.

6. Light module according to claim 3, wherein the first imaging part, arranged upstream of the high definition pixellated spatial light modulator, has an anamorphosis effect mirror.

7. Light module according to claim 3, wherein the high definition pixellated spatial light modulator comprises a digital micromirror device, the micromirrors of the digital micromirror device each being moveable between:

a first position wherein the micromirror is arranged so as to reflect light rays of a first radiation reaching it from the first imaging part of the imaging system, in the direction of an optical projection system including a second part of the imaging system, and a second position wherein the micromirror is arranged so as to reflect the light rays of the first radiation reaching it from the first imaging part of the imaging system, away from the optical projection system.

8. Light module according to claim 1, wherein the high definition pixellated spatial light modulator comprises a displaying reflective zone of the liquid crystals on silicon type.

9. Light module according to claim 1, comprising an optical projection system, wherein the high definition pixellated spatial light modulator comprises a matrix of micromirrors distributed in a plane, said matrix defining an optical axis, which spans in a central manner the optical projection system, and wherein active micromirrors of the digital micromirror device are in an active state rotated through a determined angle, preferably comprised between 6 and 15°, towards an optical element of the convergent type situated upstream of the high definition pixellated spatial light modulator and which belongs to the imaging system.

10. Light module according to claim 1, wherein a convergent type of optical element, situated upstream of the high definition pixellated spatial light modulator and which belongs to the imaging system, defines, from the light emitted by the light source, a first radiation projected onto a zone of reflection of the high definition pixellated spatial light modulator, forming on this zone of reflection an intermediate image, which is distorted by said optical element of the convergent type, extends comparatively further from the high definition pixellated spatial light modulator and nearer to another optical element onto which is directed a second radiation, coming directly from a reflection of the first radiation on the high definition pixellated spatial light modulator, the other optical element forming a first optical element of an optical projection system belonging to the imaging system.

11. Light module according to claim 10, wherein the optical projection system comprises, successively in this order, along a distancing direction relative to the high definition pixellated spatial light modulator:

the first optical element arranged as an input lens of the optical projection system so as to capture the second radiation;

a pair of optical elements, making it possible to reduce the focal length of the optical projection system relative to a longer focal length that would be obtained for the optical projection system in the absence of this pair of optical elements.

12. Light module according to claim 11, wherein the optical projection system furthermore comprises an achromat, preferably forming one of the optical elements of said pair of optical elements.

13. Light module according to claim 1, wherein the light source is part of a unit for emitting light rays provided with at least one reflecting surface distinct from the high definition pixellated spatial light modulator and making it possible to orient the light source along a direction for distancing the light relative to a zone of reflection of the high definition pixellated spatial light modulator.

14. Light module according to claim 1, wherein the light source consists essentially in one light emitting diode or in several light emitting diodes, grouped on a common mount.

15. Projector for motor vehicle, comprising a projector housing and at least one optical module according to claim 1.

16. Light module according to claim 2, wherein the determined format of said zone of reflection has a rectangular perimeter format.

17. Light module according to claim 2, wherein at least one of the optical elements of the imaging system forms said first imaging part, which comprises:

the adjustment lens for adjustment to the determined format, designed and arranged so as to concentrate the radiation from the light source by defining a contour shape of the radiation that corresponds to the shape of a perimeter of the zone of reflection defined by the high definition pixellated spatial light modulator.

18. Light module according to claim 4, wherein the first imaging part, arranged upstream of the high definition pixellated spatial light modulator has at least one transparent optical element with an anamorphosis effect.

19. Light module according to claim 4, wherein the first imaging part, arranged upstream of the high definition pixellated spatial light modulator, has an anamorphosis effect mirror.

* * * * *